United States Patent [19]

Skibowski

[11] Patent Number: 4,915,147

[45] Date of Patent: Apr. 10, 1990

[54] APPARATUS FOR FILLING CONTAINERS WITH LIQUIDS

[75] Inventor: Hubert Skibowski, Hamburg, Fed. Rep. of Germany

[73] Assignee: Dover Corporation, New York, N.Y.

[21] Appl. No.: 146,344

[22] Filed: Jan. 21, 1988

[30] Foreign Application Priority Data

Jan. 24, 1987 [DE] Fed. Rep. of Germany ..... 3702109

[51] Int. Cl.[4] ..... B65B 3/04; B67D 3/00

[52] U.S. Cl. ..... 141/181; 141/85; 141/89; 141/147; 141/163; 141/263; 141/270

[58] Field of Search ..... 74/527; 141/89, 85, 141/237, 242, 244, 255

[56] References Cited

U.S. PATENT DOCUMENTS

| | | | |
|---|---|---|---|
| 814,169 | 3/1906 | Sellenscheidt | 141/270 |
| 1,071,682 | 9/1913 | Akzinger | 141/250 X |
| 1,820,480 | 8/1931 | O'Neil | 141/250 X |
| 2,208,028 | 7/1940 | Harrington | 141/263 |
| 2,770,397 | 11/1956 | Galloway | 141/147 X |
| 2,913,016 | 11/1959 | Luther | 141/264 |

FOREIGN PATENT DOCUMENTS 2318165 12/1976 Fed. Rep. of Germany .

OTHER PUBLICATIONS

I.S.T. Industrial Pigging Systems, Dec. 1986, Dover Corp./OPW Division.

*Primary Examiner*—Ernest G. Cusick
*Attorney, Agent, or Firm*—Kinney & Schenk

[57] ABSTRACT

Apparatus for filling fluid products into container which comprises at least one feed line connectable with a reservoir for fluid products and a filling valve connects to the feed line. The filling valve comprises a tubular portion connected with the feed line. The tubular portion comprises, at its free end, a lateral end wall and an aperture. A slide sleeve is reciprocated by a positioning device and is movable coaxially of the tubular portion between open and closed positions. In its closed position, the slide sleeve sealingly engages the end wall to closed the aperture of the tubular portion. In its open position, the slide sleeve opens the aperture for product flow. Means are provided to lower the filling valve into a filling opening of a container positioned underneath the filling valve. The slide sleeve protrudes beyond the end wall in its open position and is dimensioned in its length such that it is either lowered to a position closely above the filling opening of the container or is moved into the filling opening. The slide sleeve comprises an annularly spaced portion in its inner wall which forms an axial passage between the lateral end wall and the slide sleeve in its open position.

20 Claims, 6 Drawing Sheets

FIG.6
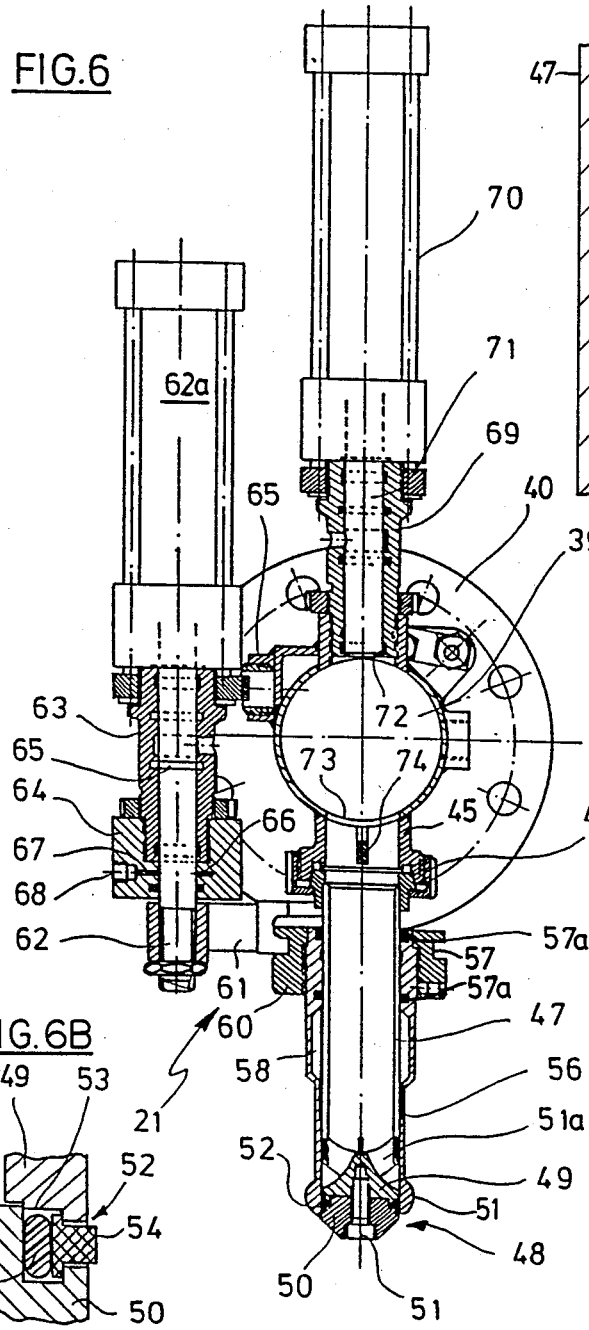
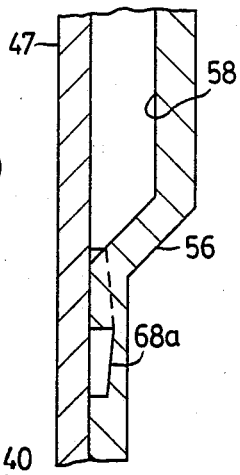
FIG.6A
FIG.6B
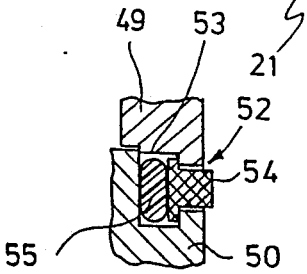

APPARATUS FOR FILLING CONTAINERS WITH LIQUIDS

The invention refers to an assembly for filling fluid products into separate containers, for instance drums.

A filling valve has been known from German patent letter 23 18 165 in which a slide sleeve is movable coaxially to a tubular portion. The slide sleeve in a retracted position opening an aperture between the tube wall and a lateral end wall positioned perpendicularly to the tube wall and is in a sealing relation with a sealing surface of the lateral end wall in its closed position. The lateral end wall is formed as a stop surface for a pig and the inner wall of the slide sleeve cooperate sealingly with the lateral end wall.

The described filling valve and other filling valves according to prior art are arranged at the end of a filling line and serve for the filling of tanks, packages and the like. Between its dwell and filling modes the filling valve has to undergo a lifting movement. According to prior art, this is accomplished by lifting or lowering the filling hose or a filling pipe or the package to be filled. To this end a respective lifting device is required. Power requirements for the lifting device are relatively high. As the lifting device has to move a relatively large mass, relatively long positioning times are necessary. The expenditure described and also the relatively long adjusting times are acceptable when filling larger containers. Conditions are different when filling packages like drums, jerry cans, cans and the like. The empty containers can be supplied relatively fast automatically. Therefore the filling cycle primarily depends on the time which is required to get the filling valve out of the filled container and to move it into the bung hole of a new container.

When filling containers it is often important to meet a calibration standard. Therefor it is necessary that the filling valve does not engage with the wall of the bung hole. This requirement necessitates that the filling valve is precisely guided primarily while moving into the bung hole. This requires for an additional effort.

Therefore it is the object of the invention to provide an apparatus for filling fluid products into separate containers which requires a relatively small effort for positioning filler valves relative to containers, and at the same time enables short times for positioning while precisely guiding the filling valve.

In the above-described filling valve according to prior art, the slide sleeve serving as a shut-off member is moved back when the filling valve is brought into the opened position. In the apparatus according to the present invention, however, the slide sleeve extends beyond the lateral end wall in the opened position. The slide sleeve is dimensioned in its length such that it moves towards the filling opening of the container or moves into it while being displaced into its open position. The slide sleeve comprises a free space at its inner wall which forms an axial passage between the lateral end wall and the slide sleeve in the open position.

In the present invention the filling valve is shaped as a telescopic part in such a way that the filling valve elongated in the open position. The degree of elongation is defined by the length of the slide sleeve or the position of the free space in the slide sleeve, respectively. The containers to be filled ordinarily are on a preset level, for instance on a roller way/scale platform. Thereby the level is preset which the filling head or the filling valve has to keep in order to enable an unrestricted transport of the containers under the filling valve. Likewise the distance is preset which has to be covered in order to sufficiently approach the bung hole of the container or to move into it. Therefore the length of the slide sleeve or the distance of the free space from the sealing portion of the slide sleeve, respectively, is fixed.

It has been recognized with the present invention that it is not necessary to lower or lift the complete filling valve or even the filling valve together with at least a part of the feed line in order to initiate or complete, the filling operation. In the apparatus according to the invention, the slide sleeve which is quite light accomplishes the positioning movement. The effort, necessary for this operation is very small as axial movement of the slide sleeve is necessary, anyway. It is obvious that the positioning time of a slide sleeve is extremely short as only a small mass has to be moved.

As only the slide sleeve moves into the bung hole in the present invention, a precise guidance of the slide sleeve can be guaranteed in such a way that an engagement with the wall of the bung hole can be safely avoided. To this end the slide sleeve is provided with an annular extension at its lower end to center it relative to the container hole. When the slide sleeve consequently dips in any further it is spaced-apart from the hole walls at its sides. Therefore the weighing operation is not influenced and the outgoing air can move out of the inside of the containers without any problems. Furthermore, the slide sleeve can be provided with pressure relief means.

In the apparatus according to the invention on the lateral end wall preferably comprises a circumferential radial sealing arrangement which engages with the inner wall of the slide sleeve. Such a construction is known in principal from the already mentioned German patent letter 23 18 165. The sealing arrangement is preferably provided with a sealing ring which is radially movably positioned in an undercut groove of the lateral end wall. A radially resilient ring, preferably formed of an elastomeric material, is positioned in the groove and underlies the inner wall of the sealing ring. The resilient ring biases the sealing ring radially outwards in such a way that it radially protrudes beyond the lateral end wall. For mounting the sealing ring in the undercut groove, the lateral end wall preferably is divided into two parts. The described sealing arrangement makes sure that it only engages with the inner wall of the slide sleeve and not with the lateral end wall.

The lateral end wall preferably is connected with the tubular portion by a plurality of radial circumferentially spaced-apart ribs. The flat ribs preferably extend axially or parallel to the axes, respectively, so that they restrict the flow only to a small degree, however, counteract a possible spin of the flow.

The outer dimensions of the slide sleeve naturally have to comply with the diameter of the bung hole which means the diameter must be smaller than the diameter of the bung hole. As the bung holes can have different dimensions, different filling valves may be necessary to comply with the respective diameters. To this end one feature of the invention provides that the tubular portion is detachably connected with a pipe connection of the feed line. Thus, the filling valve can be fastened to or dismantled from the pipe connection of the feed line by a screw coupling.

The containers normally stand upright with their bung holes pointing upwards. In accordance with a further feature of the present invention, a fluid feed line comprises a horizontal portion in which at least one pipe connection is connected with the tubular portion of the valve and points downwards. A plurality of filling valves can be connected with the horizontal portion of the feed line, the filling valves being spaced apart from each other. Each filling valve can be associated with a transport line on which the containers can be supplied to the filling valve in a row. The filling valve can be positioned very close to the feed line. When pigging i.e., purging through the use of a plug, or pig, which is passed through conduits by compressed air the feed line, only that fluid which is located immediately in the filling valve will not be purged. The remaining fluid can be removed by compressed air for instance. It is also possible to pig up to the lateral end wall, when the feed line has the same cross section as the filling valve.

In order to accomplish an adjustment to the different heights of the containers, a feature of the present invention is found in the provision of a fixture for holding the horizontal tubular portion. This fixture provides a lifting device for the horizontal tubular portion. It is obvious that the lifting device can provide an adjustment to position the filling valves for different heights of containers to effect the above-level filling according to the prior art. It can also enable the usage of a very long dimensioned filling valve. The latter consists of a filling head as described above and a longer connecting piece between the filling head and the feed line. By such a filling valve a co-called sub-level filling or partial sub-level filling can be accomplished. To this end, the filling head dips deep into the container and moves slowly upwards with the rising product level. Therefore a connecting portion being variable in its length normally has to be positioned between the stationary feed line and the filling head. The connecting tubular portion preferably consists of two hinge arms which function in a scissor-like mode and adjust themselves to the respective adjustment of the filling valve.

The filling valve according to the invention is usefully positioned at a tubular portion which comprises connecting flanges at both ends. By using the units comprising the filling valves a line of any length with a required number of filling valves of a filling assembly can be established.

It has been known from the referenced patent to form the slide sleeve as an adjustment piston which is actuated either pneumatically or hydraulically. According to the invention, another feature is to actuate the slide sleeve by an adjustment cylinder which is secured to the feed line.

Discharge of a measured amount while filling is facilitated by the fact that the filling valve comprises not only an opened and a closed position but allows for an intermediate position in which a smaller product flow per time unit is allowed to pass. In order to accomplish this, another feature of the invention provides that the piston rod of the adjustment cylinder extends through the bore of a guide member being fix in relation to the line, the piston rod comprising an annular groove and a radially movable locking element being positioned in the bore wall, the locking element being adapted to be actuated radially inwards by a locking device. If the product flow is to be diminished, the adjustment cylinder moves the slide sleeve partially into the closed position. The limitation of the adjustment is accomplished by an engagement of the locking element in the locking groove of the piston rod. The locking element can be formed by one or more locking balls. Alternatively, radially movable ring segments or the like can be provided.

In the apparatus according to the invention, pig-receiving and sending means, in the area of the filling valves in the feed line, can easily be provided in such a way that a pig-receiving means is diametrically movably positioned at the side opposite to the filling armature, the pigreceiving means being adjustable into the inlet hole of the filling valve by an adjusting cylinder. The pig-receiving means for instance can be a so-called pig-receiving spike.

A piggable filling assembly enables the filling of different products through the same feed line and the same filling valves. In accordance with another feature of the invention a plurality of reservoirs is connected to a ring-shaped feed line through a piggable T shut-off valve and that a control valve is positioned in the return portion of the feed line. A pump provides for the circulation of the medium before the filling operation in a bypass mode. Thereby it is avoided that a closing of a filling head effects a remarkable rise of pressure in another opened filling head and consequently a too high flow energy of the outgoing products. In this way it is possible to pig the complete feed line and to push back the remaining medium out of the feed line into the respective reservoir.

The present invention will now be described in details referring to the drawings in which FIG. 1 is a diagrammatic block diagram of filling according to the invention.

FIG. 6 is a section.

FIG. 6A is a fragmentary section, on a further enlarged scale, of a throttling groove.

FIG. 6B is a fragmentary section, on a further enlarged scale, of a seal.

Figure 1:
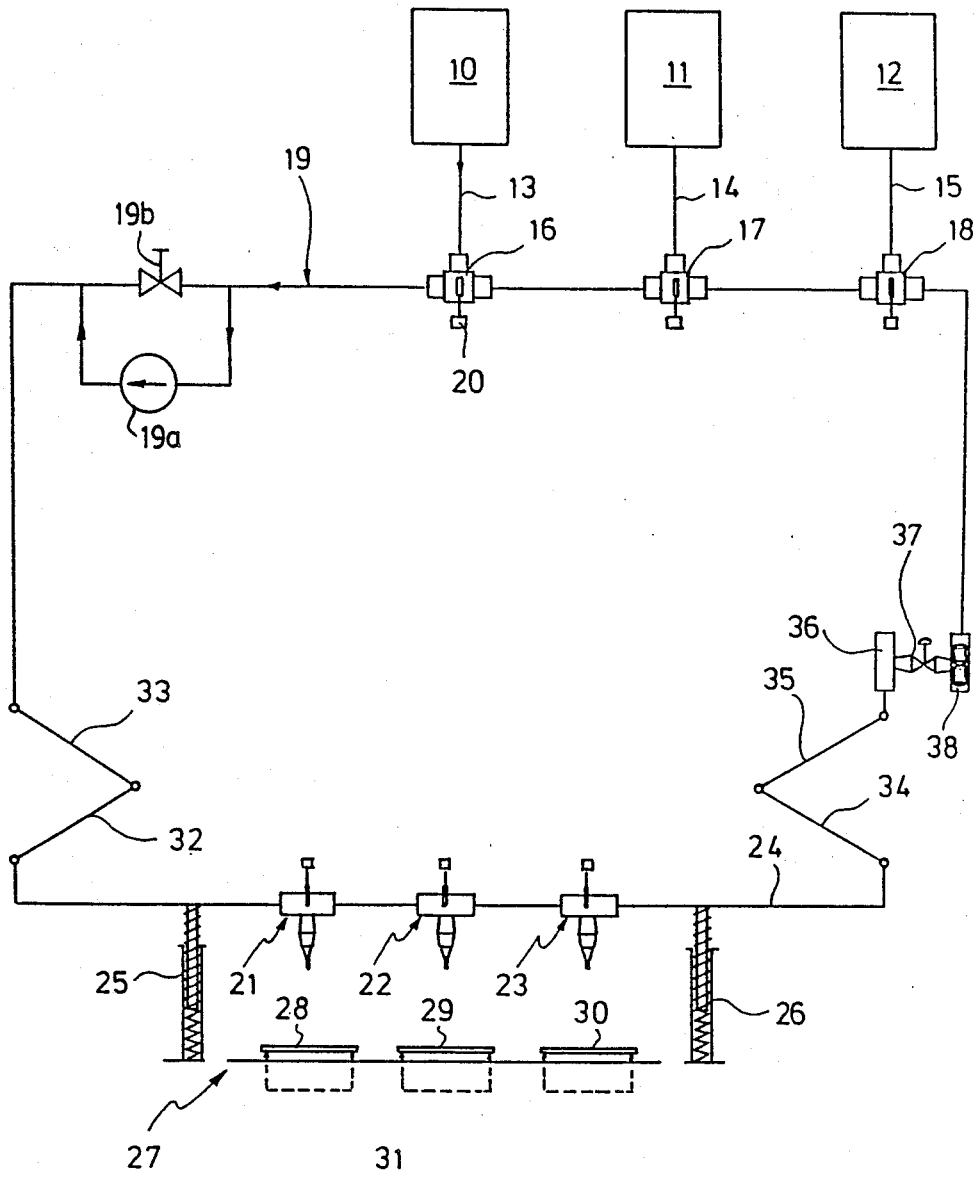

Before referring to the details shown in the drawings in more detail it is stated that each of the features described itself or in combination with other features is of significance.

In FIG. 1 three reservoirs 10, 11 and 12 can be seen which are connected with lines 13, 14, 15 with T-shaped shut-off valve 16, 17 and 18. In the lines 13 to 15 shut-off valves (not shown) can be provided. The lateral connecting arms of the T-valves 16 to 18 are positioned in the courses of a ring-shaped feed line 19. Each of the T-valves 16 to 18 is associated with an adjusting device 20. The T-shaped valves 16 to 18 are piggable i.e. a pig being sent through the line 19, can pass through these valves leaving only a minimal amount of the purged material in either their open or closed positions. A supply pump **19*a* is provided for a bypass mode. A shut-off valve 19*b* is provided in the line 19**. It is piggable as well as are the branching positions which can be formed as a piggable T-valve comparable with the T-valves 16 to 18.

In the course of the lower portion of the ring-shaped feed line 19 three filling heads 21, 22 and 23 are positioned. Details of the filling heads 21 to 23 are described further below. They are situated in a horizontal feed line portion 24 which is supported by two lifting devices 25, 26 on a base. The line portion 24 can be adjusted in its height by the lifting devices. Thereby, also the height of the filling valves 21 to 23 is varied. The filling valves 21 to 23 and the lifting devices 25 and 26 are part of a filling station 27 in which also three roller ways 28, 29 and 30 are positioned. The transport direction of the roller ways 28 to 30 is perpendicularly to the drawing plane. In the area of the filling station 27, the roller ways 28 to 30 are part of a weighing device which is indicated by the dotted lines at 31.

The horizontal line portion 24 is connected with the left branch of the feed line 19 by a first hinge arm 32 and a second hinge arm 33. The arms 32, 33 are coupled with each other by a rotating joint. The coupling of the arms 32 and 33 to the adjacent tubular portion is also effected by rotating joints. In the right area the tubular portion 24 is coupled with a hinge arm 34 by a rotating joint. The hinge arm 34 is coupled with a further hinge arm 35 by a rotating joint. The hinge arms 32 to 35 form a sort of scissor which enables an adjustment of the level of the feed line portion 24, while remaining in engaging connection with the other portions of the feed line 19.

The hinge arm 35 is connected with a pig sending and receiving station 36 by a rotating joint. The pig sending and receiving station 36 is connected with a control valve 37 which in turn is connected with a further pig sending and receiving station 38. This is connected with a tubular portion leading to the T-valve 18. Both pig stations 36 and 38 can receive two pigs each.

Containers (one is shown) to be filled with a fluid product out of the reservoirs 10, 11 or 12 are positioned on the roller ways 28 to 30 beneath the filling heads 21 to 23. During the filling operation the T-valve 16, 17 or 18 is open to select product from the desired reservoir. Before the filling operation starts, the supply pump 19*a* circulates the medium out of a reservoir through the opened valve 37, the circulated volume being larger than the maximum output volume through the three filling heads 21 to 23. The adjustment of the control valve 37 sets the bias pressure at the filling head. In this way it is made sure that not significant pressure peak is created with a sizable rise of pressure at an open filling head, while closing or throttling another filling head. This presents the accuracy of the weighing operation from being impaired. Following filling of containers with a given product a cleaning of the feed line can be effected by a pig from the pig station 38, the product returning into the respective reservoir through the opened shut-off valve 37.

Figure 2:
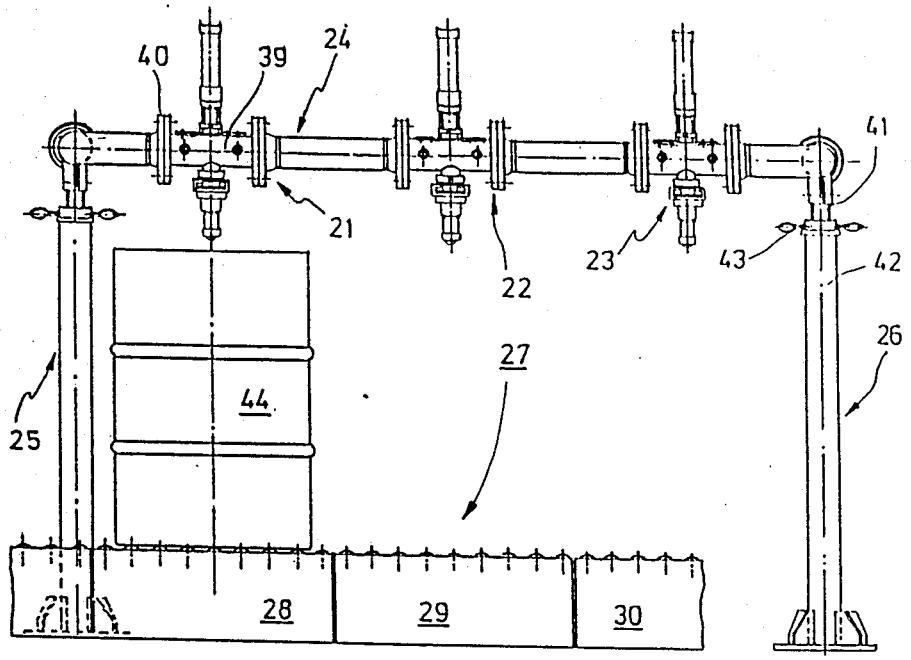
FIG. 2 is a front view of a filling station of the apparatus according to the invention.
Figure 3:
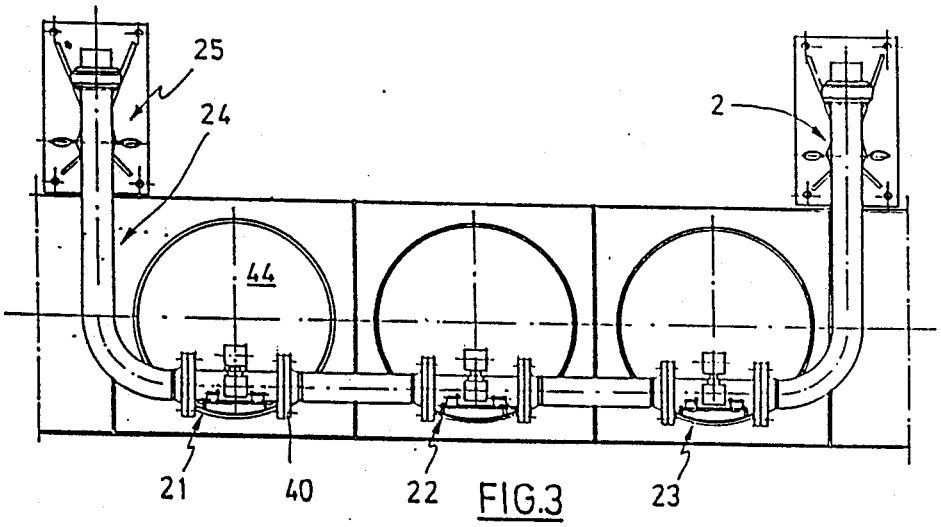
FIG. 3 is a plan view of the station of FIG. 2.
Figure 4:
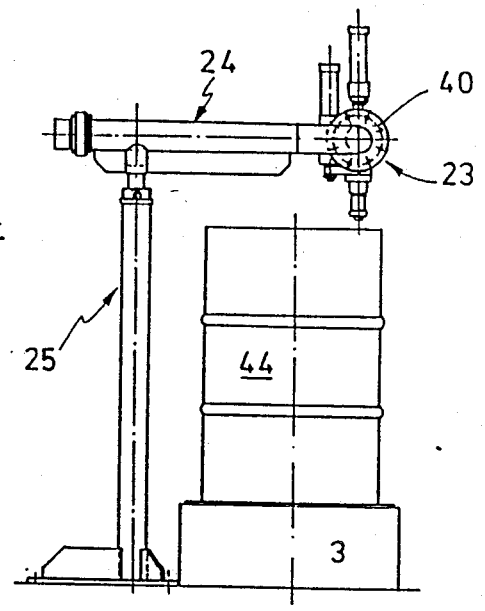
FIG. 4 is a side view of the station of FIG. 2.

Referring to the FIGS. 2 to 4 the filling station 27 becomes more apparent. As can be seen, the filling heads 21 to 23 are units which are positioned in the course of the tubular portion 24 by means of straight line portions 39 and flange 40. It is apparent that the tubular portion 24 forms a horizontally positioned U, the legs of which are supported by the lifting devices 25 and 26 from the base. The lifting devices comprise a threaded rod 41 positioned in a tube 42 (FIG. 2). An adjusting nut 43 is threaded onto the rod 41 and has a handle for adjusting the height of the rod 41. The screwed rod is connected with the tubular portion 24. As can be seen, the tubular portion 24 can be adjusted in its height in any dimension thereby also adjusting the level of the filling heads 21 to 23. In the embodiment according to the FIGS. 2 to 4 drums 44 (one is shown) being supplied at the roller ways 28 to 30 are to be filled.

Figure 5:
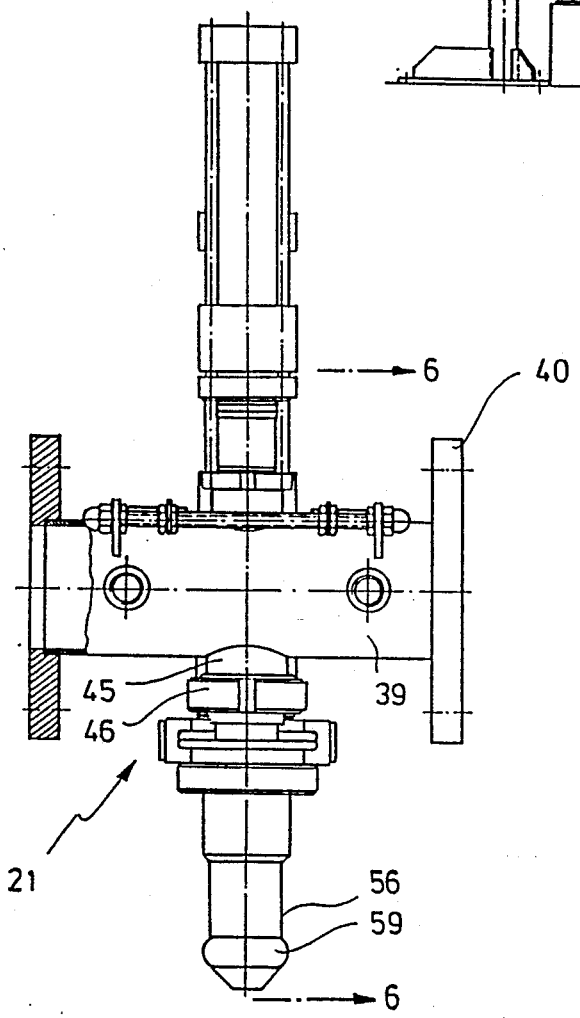
FIG. 5 is a front view, on an enlarged scale, of a filling head of the filling station of FIGS. 2 to 4.

Referring to the FIGS. 5 and 6 the filling head 21 is described in more details. A pipe connection 45 pointing radially downwards is fastened to the line portion 39. The pipe connection 45 comprises an outer thread on an enlarged part upon which a coupling nut 46 is screwed. The coupling nut 46 serves for attaching a tubular portion 47 through a connecting piece (no reference numeral). The tubular portion 47 is smooth on its inner and outer surface. At its lower, discharge end it holds a lateral end wall 48 consisting of two parts 49, 50 which are positively connected with each other in a radial plane and are tightened to each other with a screw 51. The part 49 is connected with the end of the tubular portion 47 by a plurality of flat ribs 51*a* being circumferentially evenly spaced apart. The plane of the ribs 51*a* coincides with planes of diameters of the tubular portion 47. A radially acting circumferential seal 52, which is shown in an enlarged scale in FIG. 6B, is positioned on the lateral end wall 48. It is obvious that the parts 49, 50 form an undercut annular groove 53 wherein is positioned an enlarged portion of the sealing ring 54 which protrudes radially outwards over a narrowed gap of the groove beyond the lateral end wall 48. An elastomeric ring 55 is positioned radially inwardly of the sealing ring 54, and biases the sealing ring 54 radially outwardly.

The tubular portion 47 is coaxially enclosed by a slide sleeve 56 which sealingly slides, at its upper end, on the tubular portion 47. O-rings 57*a* provide this sliding seal. Underneath this sealing portion the inner surface of the sleeve 56 is spaced from the tubular portion 47 at 58. The spaced portion 58 is formed by a radial enlargement of the slide sleeve 56. Below the annular spaced portion 58 the sleeve 56 slidably engages the tubular portion 47. In the position shown in FIG. 6 the lower end of the inner wall of the sleeve 56 engages the annular seal 52. The filling valve formed by the tubular portion 47 and the sleeve 56 is thus closed. Product entering from the line portion 39 into the pipe connection 45 cannot leave the filling valve. However, if the slide sleeve 56 is displaced downwardly until the spaced portion 58 spans the seal 52 a passage is created for the product to flow through the apertures between the ribs 51*a*. The product can then flow downwards past the end wall 48 into the discharge end of the slide sleeve 56 as it projects into a container. It is apparent from FIGS. 5 and 6 that the slide sleeve 56 comprises an annular extension at its end at 59. This extension serves the function of centering sleeve 56 relative to the opening in the container and for maintaining a distance to the wall of the opening in order not to influence the weighing operation and to let the air escape.

At the upper end of the slide sleeve 56 there is ring 60 having a circumferential groove 57. The groove of the ring 60 is engaged by a semi-ring 61 which is positioned on a piston rod 62 of an adjusting cylinder or positioning 62*a*. With this arrangement different size filling heads can be quickly mounted of the coupling nut 46. When the piston rod 62 is displaced, the slide sleeve 56 correspondingly moves in vertical direction. The piston rod extends through axial bores of two guide members 63, 64 being screwed with each other and being secured with the line portion 39 at 65*a*. The piston rod 62 comprises a circumferential groove 65. A row of locking balls 66 is positioned in a circumferential groove in the lower guide member 64, the locking balls being enclosed by an elastomeric ring 67. The outer wall of the ring 67 corresponds with a compressed air connecting bore 68. When the bore 68 is impinged by compressed air, the ring 67 actuates the locking balls 66 radially inwards. When the groove 65 reaches the locking balls 66 and bore 68 is pressurized, the movement of the piston rod 62 comes to a sudden stop. The groove 65 is positioned in such a way that the slide sleeve 56 holds a throttling position in which an axial groove 68*a*in the inner wall of the sleeve 56, the groove being variable in its cross section, forms a throttled passage in the area of the sealing arrangement 52. The groove in the slide sleeve preferably is inclined in order to give the medium a spin. Thereby it is avoided that a thin sharp jet beam is discharged which could cause an inaccuracy in the measuring results.

Diametrically opposite the pipe connection 45 a further guide sleeve 69 is positioned. An adjusting cylinder 70 is secured to the guide sleeve. A pig-receiving spike 71 is guided in the guide sleeve 69, the pig-receiving spike being adapted to be actuated by the adjusting cylinder 70. The pig-receiving spike 71 can be moved through an upper aperture 72 in the tubular piece 39 crossing the tubular piece 39 diametrically into the opening 73 of the pipe connection 45 where it moves against a stop 74 for limitation. In this case the pig-receiving spike 71 forms a stop for a pig in the area of the filling head 21.

Figure 7:
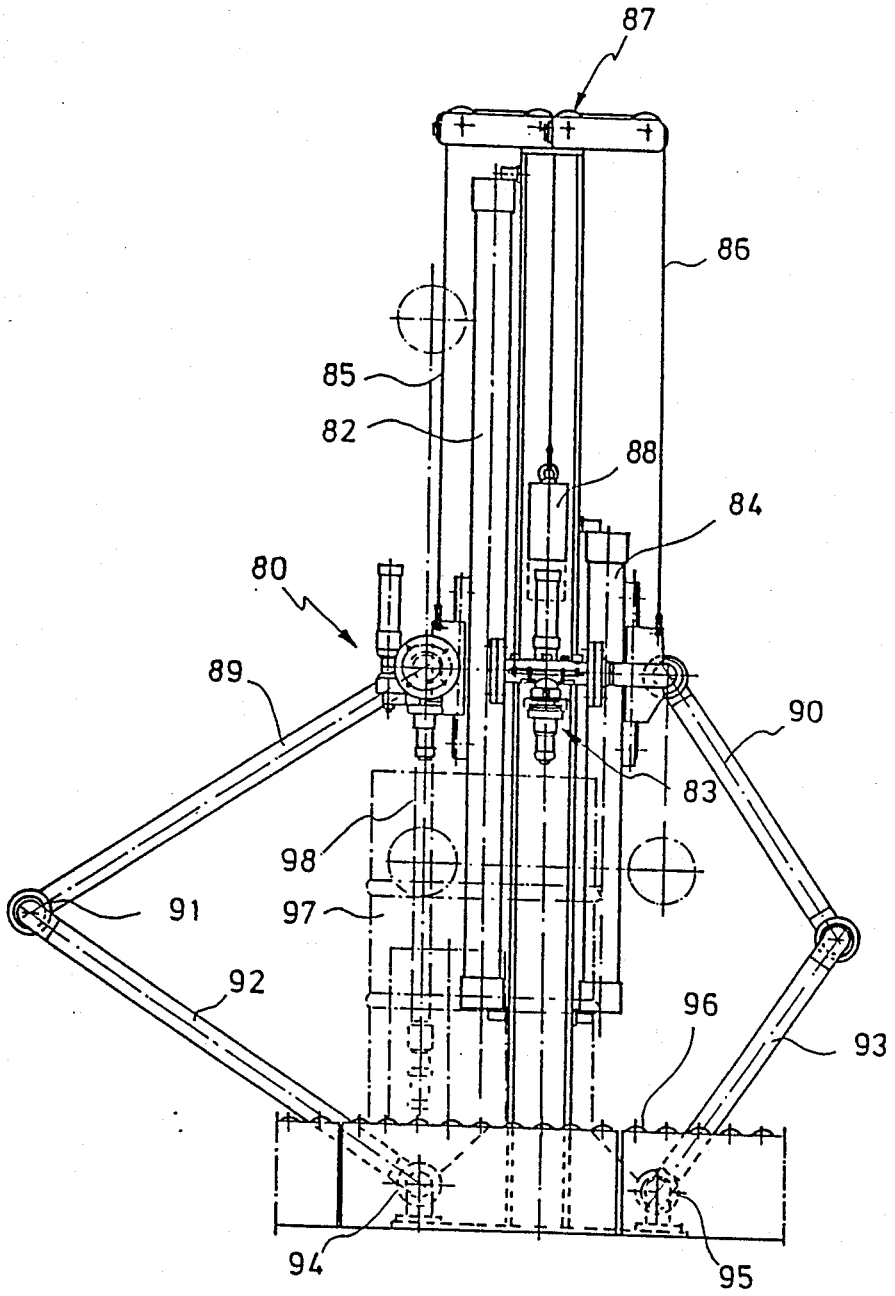
FIG. 7 is a side view of a modified embodiment of a filling station.
Figure 8:
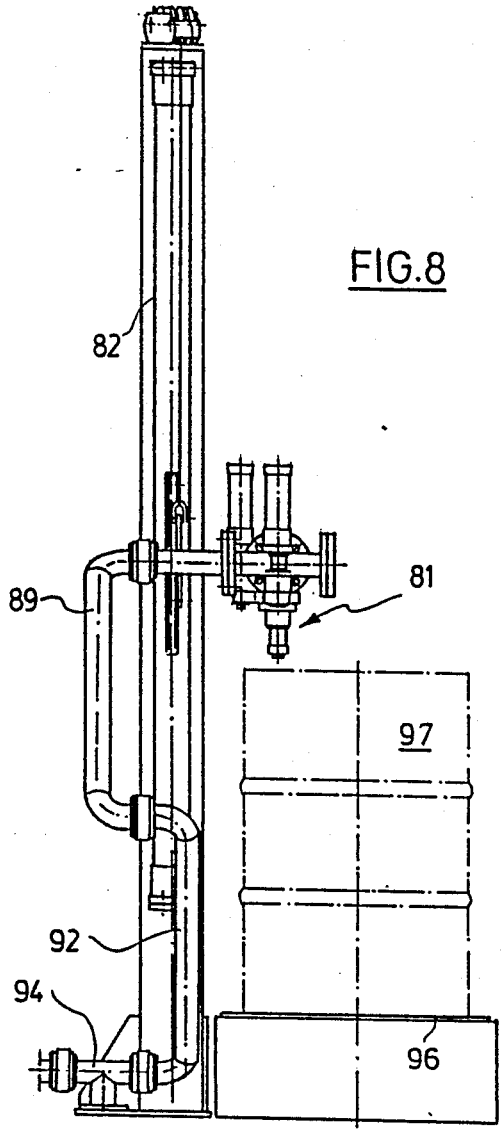
FIG. 8 is a different side view of a filling station according to FIG. 7.
Figure 9:
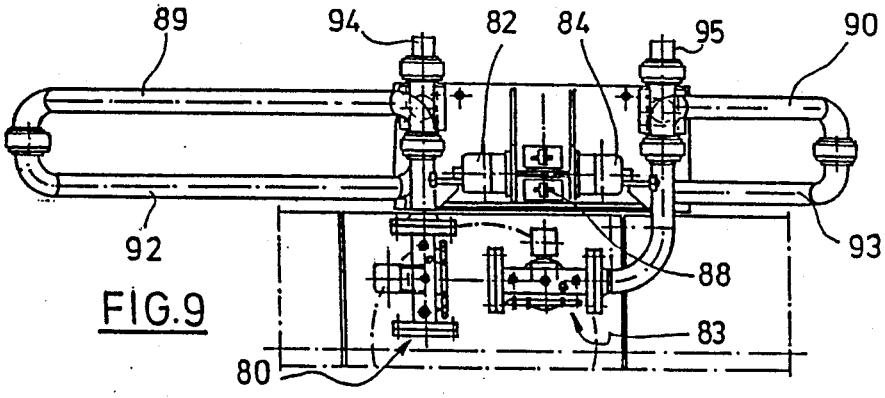
FIG. 9 is an upper view of a filling station according to FIG. 8.

In the embodiment according to the FIGS. 7 to 9 a first filling head 80 is connected with the piston of a cylinder 82 which is laterally slotted. A second filling head 83 is connected with a piston of a cylinder 84 which is also laterally slotted. The filling heads 80, 83 correspond with the filling heads 21 to 23 so that their construction need not be further explained. The filling heads 80, 83 hang on cables 85, 86 which are guided over an upper roller arrangement 87 and are connected with a weight, each, one of which can be seen at 88 for the filling head 83 in FIG. 7. The filling heads 80, 83 are articulatedly connected to hinge arms 89, 90, respectively. The hinge arms 89, 9- are connected with hinge arms 92, 93, respectively, by rotating joints 91. The hinge arms 92, 93 are connected with stationary feed lines 94, 95, respectively by rotating joints, the feed lines being positioned under the level of a roller way 96. The roller way serves for the transportation of drums 97, one of which is shown in the FIGS. 7 to 9. The filling heads 80, 83 can be adjusted to a wide degree in their height by the adjusting cylinders 82, 84. The hinge arrangement 89 to 93 effect the constant connection with the feed lines 94, 95. It has to be mentioned that the hinge arrangement 89 to 93 as well as the filling heads 80 and 83 are piggable up to the filling valves. The short filling valves as shown in full lines in the FIGS. 7 to 8 and which are like the filling valve according to FIGS. 5 and 6 can be replaced by a relatively long filling valve as it is shown in FIG. 7 in dash-dotted lines at 98. By a correspondingly elongated filling valve the latter can be moved down to the bottom of the drum 97 so that a sub-level filling is possible. When the filling continues, the valve 98 is lifted synchronously until the slide sleeve protrudes so far into the bung hole as it is usual in a normal filling operation. The movement as described is accomplished by the cylinders 82, 84. The closing of the filling valve is accomplished in such a way as has been described in connection with the FIGS. 5 and 6, i.e. the slide sleeve is moved upwards out of the bung hole to release the drum 97 for further transport.

It is apparent that the described parts of the filling station according to the FIGS. 7 to 9 are secured by a suitable support. It can be seen from FIG. 9 that a double T profile is used to this end.

I claim:

1. In an apparatus for filling containers comprising
a feed line having a portion for connection with a source of a liquid product, and
a filling valve having an inlet connected to the feed line, wherein
the filling valve comprises
a tubular portion connected at one end with the feed line and having a lateral end wall with an aperture therein, at an opposite, discharge end,
a slide sleeve telescoped over said tubular portion,
valve seal means effective between said tubular portion and said sleeve for closing said end wall aperture,
said slide sleeve being movable axially relative to the tubular portion and having an upper, closed position wherein the end wall aperture is closed and a lower, open, discharge position wherein the aperture is open for flow of product therethrough.
means for reciprocating the slide sleeve between its closed and discharge positions, and
means for positioning the filling valve immediately above an opening of a container positioned therebeneath,
the improvement wherein
the slide sleeve, in its discharge position, is projected beyond the lateral end wall of the tubular portion and into the container opening, and
passageway means are provided for flow of fluid from the tubular portion through the discharge end of the sleeve.

2. In an apparatus as in claim 1, wherein
the passageway means is provided by an annular portion of the slide sleeve which is spaced from the tubular portion.

3. In an apparatus as in claim 2, wherein
the valve seal means includes a circumferential radial seal which sealingly engages the inner wall of the slide sleeve in its closed position.

4. In an apparatus as in claim 3, wherein
the lateral end wall includes an undercut groove, and
the radial seal comprises a sealing ring positioned in said groove and an inner resilient ring, also disposed in said groove and urging the sealing ring outwardly of said groove and into sealing relation with said slide sleeve.

5. In an apparatus as in claim 2, wherein
a groove is provided in the inner wall of the slide sleeve and extends downwardly from the spaced annular portion, to provide for a reduced flow of product in an intermediate position of the slide sleeve.

6. In an apparatus as in claim 5, wherein
the cross section of said groove decreases in a direction away from the spaced portion of the slide sleeve.

7. In an apparatus as in claim 5, wherein
said groove is angled to impart a spin to the product as it is discharged from the filling valve.

8. In an apparatus as in claim 5, wherein the means for reciprocating the slide sleeve comprise a fluid cylinder having a piston rod, and means are provided for locking the piston rod in an intermediate position wherein the groove in the slide sleeve restricts flow of product from the tubular portion.

9. In an apparatus as in claim 8, further comprising a block in which the piston rod is slidable, and further wherein the locking means comprise a circumferential groove in the piston rod, a series of locking balls mounting in said block and a flexible member encircling the locking balls, and means for introducing pressurized air against said flexible member to force the flexible member against the locking balls and displace the balls into engagement with the groove in the piston rod.

10. In an apparatus as in claim 1, wherein the lateral end wall is connected to the tubular portion by a plurality of radial, circumferentially spaced ribs which define a plurality of apertures for the flow of product from said tubular portion.

11. In an apparatus as in claim 1, wherein the feed line comprising a laterally projecting pipe connection and the filling valve is detachably connected to said pipe connection.

12. In an apparatus as in claim 11, wherein the feed line includes a pipe section having connecting flanges at its opposite ends, and the pipe connection projects from said pipe section.

13. In an apparatus as in claim 11, wherein a coupling nut is provided to detachably secure the tubular portion to the pipe connection, the means for reciprocating the slide sleeve comprise a fluid cylinder having a piston rod, a grooved ring is provided at the upper end of the slide sleeve, and a semi-ring connected to the lower end of the piston rod engages the groove of the ring, enabling the slide sleeve to be reciprocated, while permitting the filler head to be readily removed for replacement by another filler head.

14. In an apparatus as in claim 1, wherein the feed line comprises a horizontal portion on which the filler head is mounted, and means are provided for adjusting the height of the horizontal portion.

15. In an apparatus as in claim 14, wherein the portion of the feed line which is adapted for connection with the product source is relatively fixed, and the articulated pipe connections are provided between the relatively fixed portion and the horizontal portion.

16. In an apparatus as in claim 15, wherein the horizontal line portion is U-shaped and the height adjusting means are connected to the legs of the U.

17. In an apparatus as in claim 1, wherein pig receiving means are movably positioned above the filling valve, said pig receiving means being displaceable into the inlet to said tubular portion.

18. In an apparatus as in claim 17, wherein the feed line is connectable with a plurality of sources of products, the feed line is ring shaped, a T-shut off valve is provided for each source of product, a shut off valve is provided in the return portion of the feed line, and a pump is provided to circulate product through the feed line.

19. In an apparatus as in claim 18, wherein the pump is connected in parallel with a second shut off valve in the feed line, to provide for a bypass mode.

20. In an apparatus as in claim 18, wherein the T-shut off valves are piggable.

* * * * *